US006446739B1

(12) United States Patent
Richman et al.

(10) Patent No.: US 6,446,739 B1
(45) Date of Patent: Sep. 10, 2002

(54) ROCK DRILL BIT WITH NECK PROTECTION

(75) Inventors: Lance T. Richman; Peter T. Cariveau, both of Ponca City, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/619,114

(22) Filed: Jul. 19, 2000

Related U.S. Application Data

(60) Provisional application No. 60/144,527, filed on Jul. 19, 1999.

(51) Int. Cl.[7] ..... E21B 10/08; E21B 17/10

(52) U.S. Cl. ..... 175/331; 175/426; 175/325.2

(58) Field of Search ..... 175/320, 325.2, 175/426, 432, 431, 331, 374; 403/23

(56) References Cited

U.S. PATENT DOCUMENTS 2,807,444 A * 9/1957 Reifschneider ..... 255/313
3,800,891 A * 4/1974 White et al. ..... 175/374
5,415,243 A * 5/1995 Lyon et al. ..... 175/331
6,116,357 A 9/2000 Wagoner et al. ..... 175/228
6,173,797 B1 * 1/2001 Dykstra et al. ..... 175/374

FOREIGN PATENT DOCUMENTS

EP 872624 A2 * 10/1998 ..... E21B/10/54

* cited by examiner

*Primary Examiner*—David Bagnell
*Assistant Examiner*—Daniel P Stephenson
(74) *Attorney, Agent, or Firm*—Conley, Rose & Tayon P.C.

(57) ABSTRACT

A rotary drill bit for boring a bore hole in an earthen formation includes a bit body having a pin end, a cutting end and a longitudinal axis and including at least two legs extending from the cutting end. Each of the legs includes a leading side surface, a trailing side surface, and a shoulder, and each of the legs further includes a bearing and a cutter cone rotatably supported on the bearing. The bit body further including a fluid flow system that includes a flowway in the pin end. The flowway is in fluid communication with at least one exit port in the cutting end. The bit body further includes a neck between the shoulders and the pin end and a hard, wear-resistant material on at least a portion of the neck.

26 Claims, 5 Drawing Sheets

ROCK DRILL BIT WITH NECK PROTECTION

RELATED APPLICATIONS

The present application claims benefit of the priority date of U.S. provisional application Ser. No. 60/144,527, filed Jul. 19, 1999, and entitled "Improved Rock Drill Bit With Neck Protection."

STATEMENT REGARDING FEDERALLY SPONSORED RESEARCH OR DEVELOPMENT

Not applicable.

TECHNICAL FIELD OF THE INVENTION

The present invention relates generally to mining bits adapted to have a longer life. More particularly, the present bits include modifications that enable them to withstand more wear than has heretofore been possible. Still more particularly, the present bits include a layer of protective material in the space between the bit threads and the shoulder of the bit.

BACKGROUND OF THE INVENTION

The present application incorporates by reference in their entireties U.S. provisional application Ser. No. 60/025,858, filed Sep. 9, 1996, and application Ser. No. 08/925,700, filed Sep. 9, 1997 and now issued as U.S. Pat. No. 6,116,357, both entitled Improved Rock Drill Bit.

Drill bits are generally known, and fall into at least two categories. Drill bits used for drilling petroleum wells and drill bits used in the mining industry are both well known in the art. While these two types of bits superficially resemble each other, the parameters that affect the operation of each are completely different. Petroleum drill bits typically use a viscous, heavy drilling fluid (mud) to flush the cuttings from the vicinity of the bit and carry them out of the hole, whereas mining bits typically use compressed air to achieve the same purpose. Petroleum bits typically drill deep holes, on the order of thousands of feet, and each bit typically drills several hundreds or thousands of feet before being removed from the hole. In contrast, mining bits are used to drill relatively shallow holes, typically only 30–50 feet deep, and must be withdrawn from each shallow hole before being shifted to the next hole, resulting in severe backreaming wear. For these reasons, the factors that affect the design of mining bits are very different from those that affect the design of petroleum bits.

For instance, the viscosity and density of the drilling mud makes it possible to flush the cuttings from the hole even at relatively low fluid velocities. The air used to flush cuttings from mining holes, in contrast, is much less viscous and dense than drilling mud and therefore must maintain a rapid velocity in order to successfully remove the rock chips. The rapid flow of air across and around a rock bit greatly increases the erosive effect of the cuttings, particularly on the leading portions of the bit.

In addition, certain formations and certain drilling operations tend to cause extreme wear to the area adjacent to the cutting leg shoulder. For example, in some cases wear occurs between the let shoulder and the pin connection. Such wear is particularly a problem under poor cleaning conditions. In some instances, wear in this area under-cuts the leg shoulder and damages the pipe adapter that connects the bit to the drill string. If not checked, the wear will continue until the pin connection sealing face is destroyed on the bit or the adapter, or both.

Hence it is desirable to provide a mining bit that provides increased protection for the reservoir and its plug and opening. It is further desired to provide a bit that is capable of withstanding wear on its shoulders and legs during backreaming or as the bit is being withdrawn from a hole.

SUMMARY OF THE INVENTION

The present invention relates to drill bits that have been modified to withstand particular wear patterns that affect the portion of the bit body between the leg shoulder and the pin end of the bit. The present invention comprises applying a hard, wear resistant material to the area directly between the leg shoulder and the last machine section of the pin connection formed when the leg components are assembled. The hard, wear resistant material can be hardfacing such as welded on hard metal, flame spray applied hard metal, D-gun coating or, most preferably, sintered tungsten carbide inserts or sintered tungsten carbide inserts having a wear resistant surface, such as synthetic diamond or PCBN. The material can be applied in the form of a coating, as inserts, or as an annular piece.

In one embodiment of the invention, a drill bit comprises a bit body having a pin end, a cutting end and a longitudinal axis and including at least two legs extending from said cutting end, each of the legs including a leading side surface, a trailing side surface, and a shoulder, each of the legs further including a bearing and a cutter cone rotatably supported on the bearing. The bit body further includes a fluid flow system, including a flowway in the pin end, the flowway being in fluid communication with at least one exit port in the cutting end. The bit body further includes a neck between the shoulders and the pin end and a hard, wear-resistant material on at least a portion of the neck.

In another embodiment, a drill bit comprises a bit body having a pin end, a cutting end and a longitudinal bit axis and at least two legs extending from said cutting end, each of the legs including a bearing and rotatably supporting a cutter cone on the bearing. The bit body further includes a fluid flow system and a neck between the pin end and the legs. Each of the legs includes a leading side surface, a trailing side surface, and a center panel, at least one of said legs is asymmetric such that its trailing side surface is larger than its leading side surface. The fluid flow system includes a flowway in the pin end in fluid communication with at least one exit port in the cutting end, with the exit port being defined by a nozzle boss and disposed adjacent to one of said legs. The bit includes a hard, wear resistant material on at least a portion of the neck.

In still another embodiment, a drill bit comprises a bit body having a pin end, a cutting end, at least two legs extending from said cutting end, and a longitudinal bit axis and further including a fluid flow system, including a flowway in said pin end in fluid communication with at least one exit port in said cutting end, said exit port being defined by a nozzle boss and disposed adjacent one of said legs. Each of the legs includes a leading side surface, a trailing side surface, a shoulder and a center panel, and each of the legs is asymmetric such that more of the mass of the bit body lies between its trailing side surface and a plane through the bit axis and the center of its center panel than lies between its leading side surface and said plane. The bit body further includes a lubrication system in one of the legs, the lubrication system comprises a lubricant reservoir in fluid communication with the bearing, the reservoir comprises a cavity formed in the leg and having an opening in the trailing side surface one of the legs. The bit includes a hard, wear resistant material on at least a portion of the neck.

BRIEF DESCRIPTION OF THE DRAWINGS

For a detailed description of the preferred embodiment of the invention, reference will now be made to the accompanying drawings wherein.

DETAILED DESCRIPTION OF THE PREFERRED EMBODIMENTS

Figure 1:
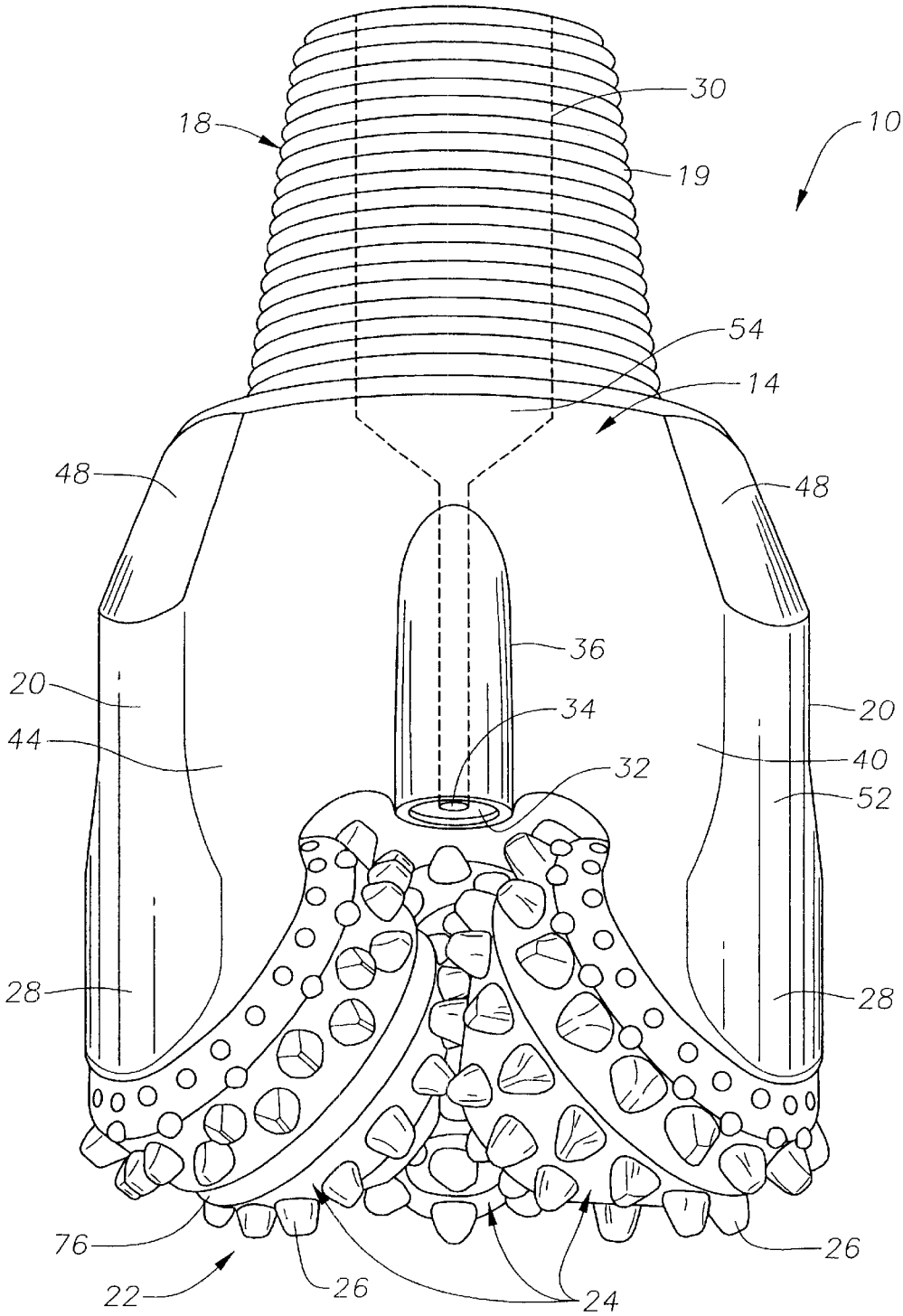
FIG. 1 is an isometric view of a conventional roller cone drill bit.

The presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic form in the interest of clarity and conciseness.

Referring initially to FIG. 1, a rotary cone rock bit 10 is shown having a bit body 14 with an upper or pin end 18 including threads 19 for connection with a drill string of a drilling rig (not shown) and a lower, and a cutting end 22 for cutting a bore hole in an earthen formation. The cutting end 22 of the bit body 14 is shown, including three rotating cutter cones 24, each having a multitude of protruding cutting elements 26 for engaging the earthen formation and boring the bore hole as the bit is rotated in a clockwise direction. The cutting elements 26 may be tungsten carbide inserts or other suitable types of inserts or cutting elements, or may formed integrally with the bit. Each cutter cone 24 is rotatably mounted upon a respective leg portion 28 of the bit body 14.

The leg portions 28 are individually formed by forging and machining processes. Thereafter, each cutter cone 24 is mounted upon a cantilevered journal portion of one of the legs 28, and the legs 28 are connected by conventional methods, such as by welding. It should be understood that the bit body 14 can be formed with two or over three cutter cone/leg pairs. A flowway 30 (shown in phantom) is formed within the bit body 14 for allowing the flow of the drilling fluid from the surface, through the pin end 18 of the bit body 14 and out into the bore hole (not shown) through one or more nozzles 32. Each nozzle 32 extends between the flowway 30 and a port 34 in one of the legs 28. A nozzle boss 36 is typically disposed on each leg 28 about and above the nozzle port 34. Drilling fluid directed thus through the drill bit 10 serves to cool the bit and to transport rock cuttings and earthen debris up and out of the bore hole.

Each leg 28 of the bit body includes a leading side 40, a trailing side 44, a center panel 52, and a shoulder 48. As the bit 10 is rotated during operation, the leading side 40 of each leg 28 leads the rotational path of the leg 28, followed by the shoulder 48 and center panel 52, which are followed by the trailing side 44. As measured parallel to the longitudinal axis of the bit, the space between the top end of shoulders 48 and the lower end of threads 19 defines a neck 54. In conventional bits, neck 54 is particularly vulnerable to wear.

Figure 2:
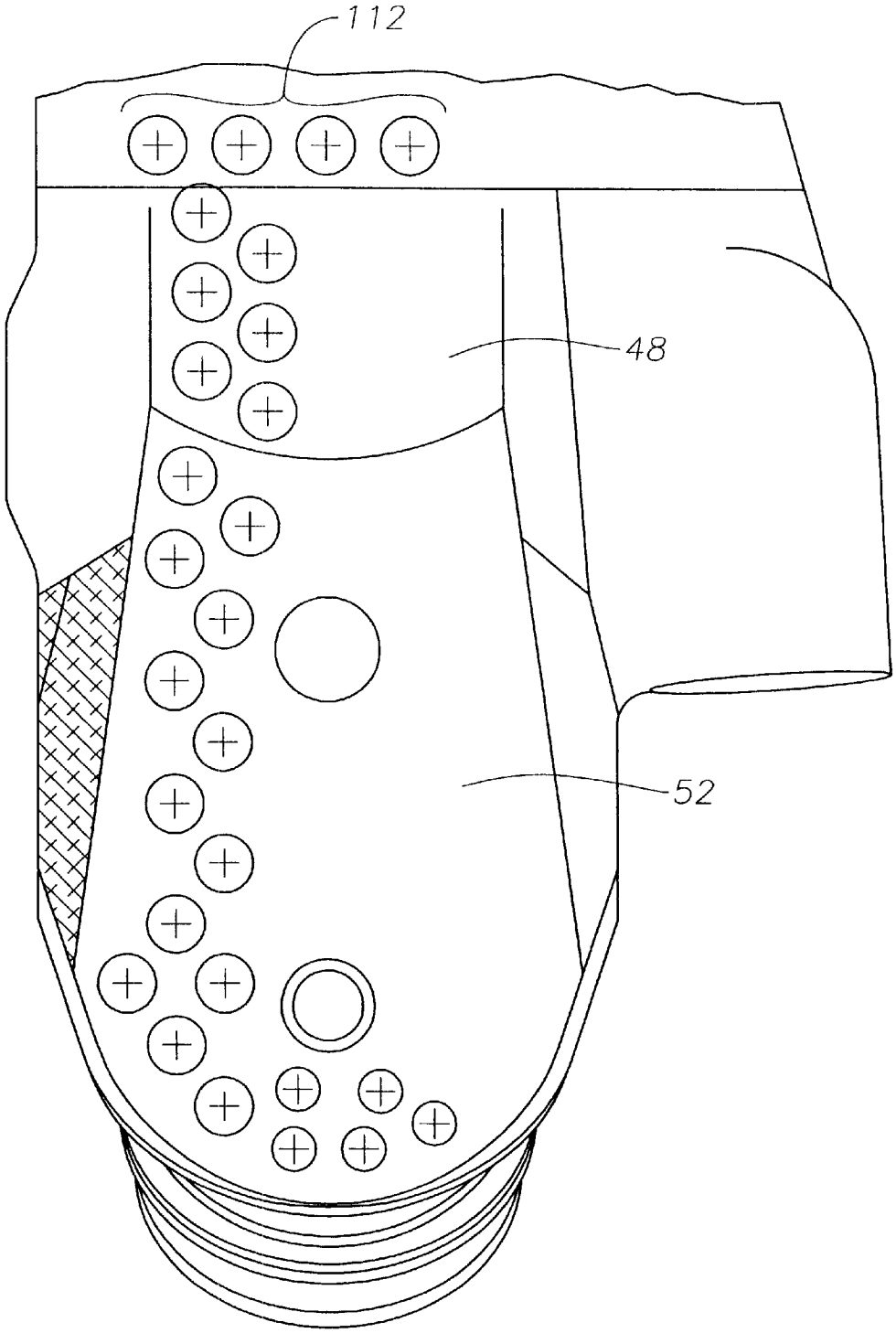
FIG. 2 is a partial side view showing one leg of a roller cone bit constructed in accordance with a first embodiment of the present invention.

Referring now to FIG. 2, according to the present invention, a hard, wear-resistant material is applied to at least some portions of neck 54. In one preferred embodiment, wear-resistant material is applied to the area directly between the leg shoulder 48 and the last machined section of the pin connection formed when the leg components are assembled, as indicated at reference numeral 112.

Figure 3:
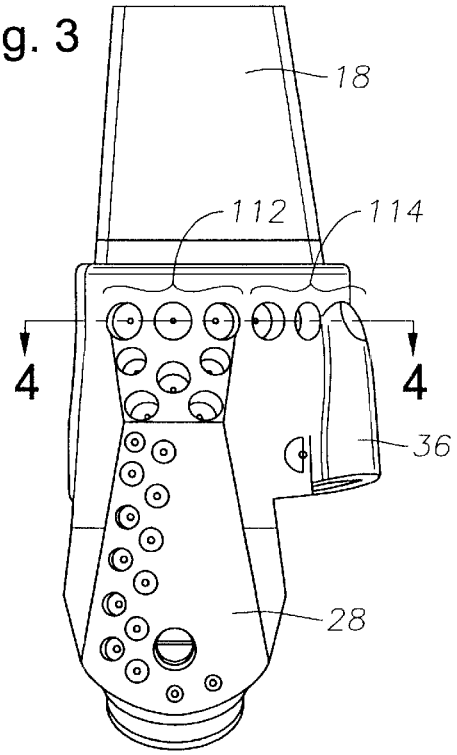
FIG. 3 is a partial side view showing one leg of a roller cone bit constructed in accordance with a second embodiment of the present invention.
Figure 4:
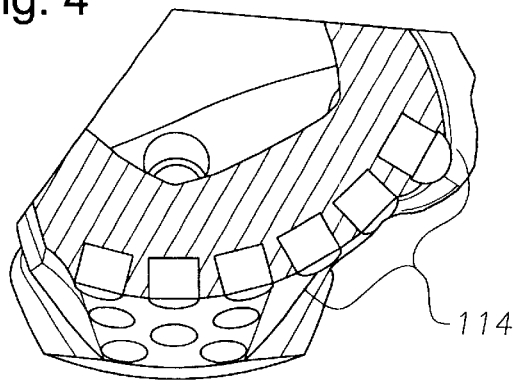
FIG. 4 is a top view of the embodiment shown in FIG. 3.
Figure 5:
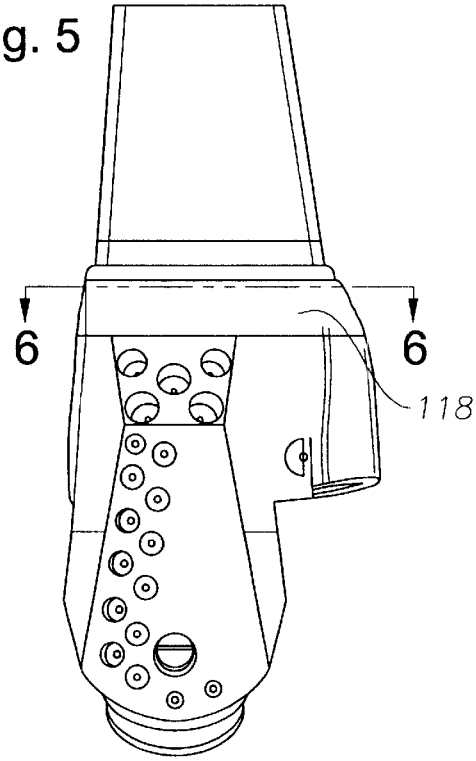
FIG. 5 is a partial side view showing one leg of a roller cone bit constructed in accordance with a third embodiment of the present invention.
Figure 6:
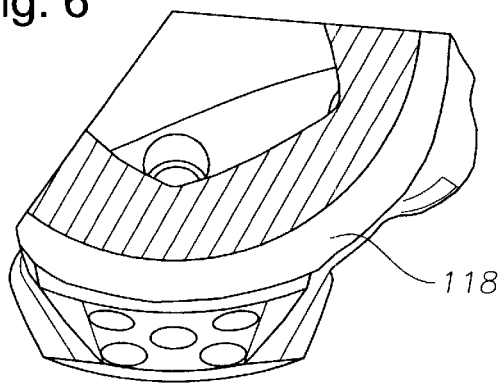
FIG. 6 is a top view of the embodiment shown in FIG. 5.
Figure 7:
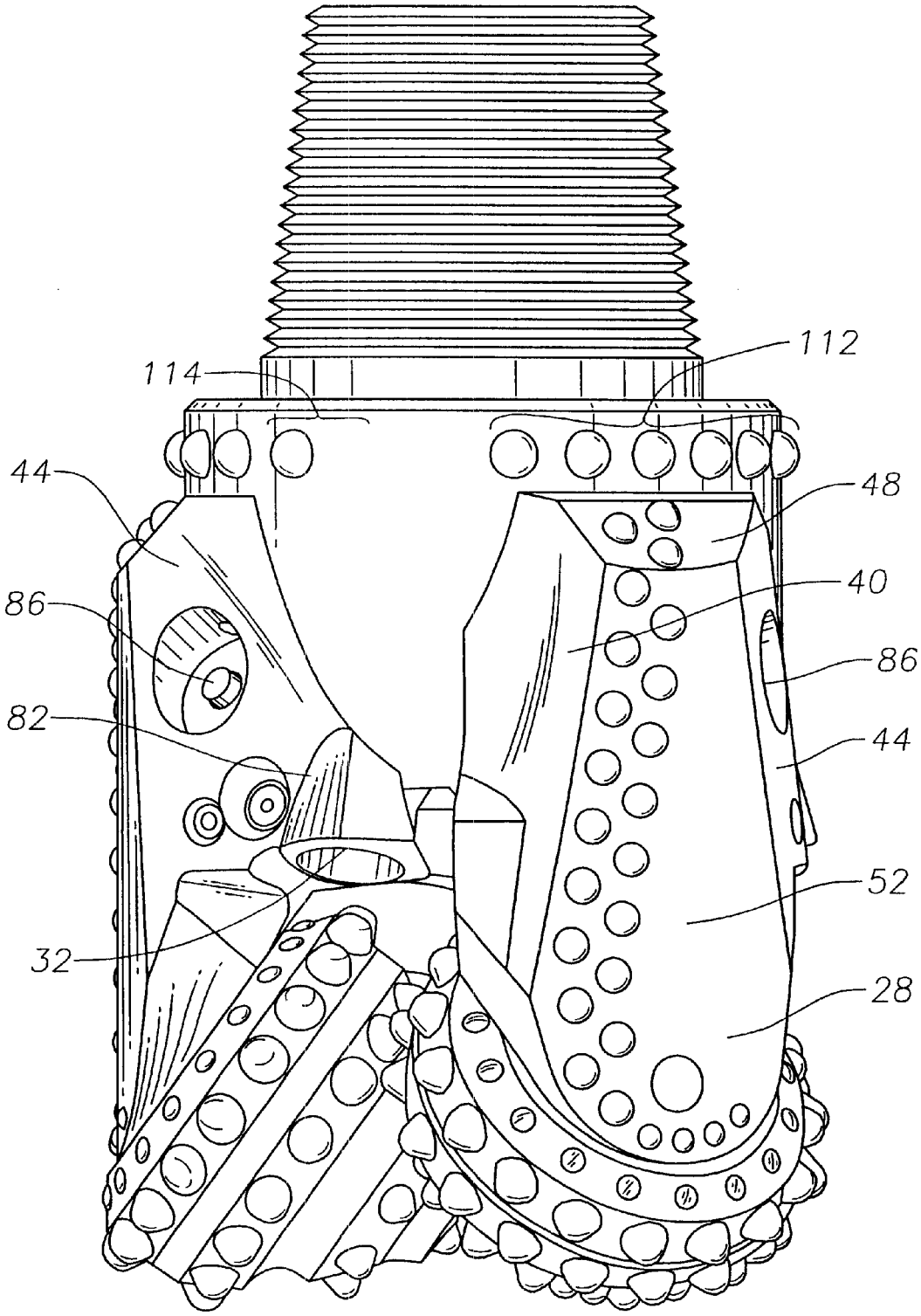
FIG. 7 is an isometric view of a roller cone bit in accordance with a first embodiment of the present invention.
Figure 8:
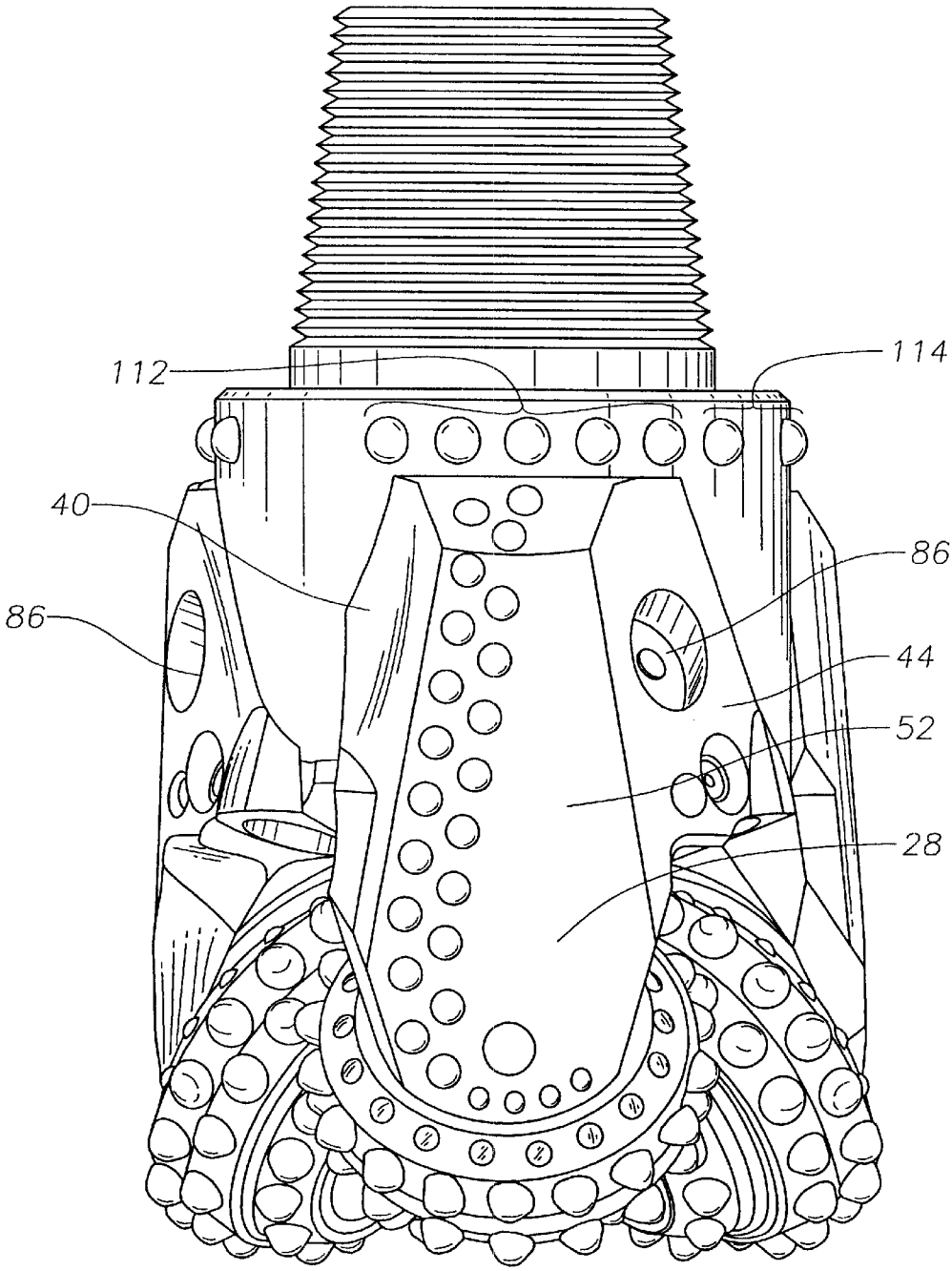
FIG. 8 is an isometric view of the embodiment shown in FIG. 7, rotated slightly so as to obtain a front view of the leg portion.

Alternatively, or in addition to the foregoing, the present invention comprises applying a hard wear-resistant material to neck 54 between the nozzle and the pin connection. An example of this placement, in combination with the placement at position 112, is shown at 114 in FIGS. 3 and 4. While wear-resistant material can be positioned at 114 alone, when wear-resistant material is positioned at both 112 and at 114, the effect is to form an annular region of protection about the circumference of neck 54. In this case, the hard wear resistant material can be configured as an annular piece that protects the entire circumference of neck 54, as shown at 118 in FIGS. 5 and 6.

The wear-resistant material can be applied as either localized applications that cover less than all of a given region on the bit surface, or as full-coverage applications that cover all of a given region on the bit surface, such as an annular application covering all or a portion of neck 54. Examples of suitable materials that can be used as the wear-resistant material include: welded-on hard metal, flame spray applied hard metal, D-gun coating and, most preferably, sintered tungsten carbide inserts, and sintered tungsten carbide inserts having a wear-resistant surface, such as synthetic diamond or PCBN. For example, an annular region of protection can be provided using an annular piece of hard metal, an annular region of coating, an annular sintered piece, or an annular substrate that is mounted on the bit body between the shoulder and the pin connection and into which a plurality of diamond coated inserts are affixed or a plurality of diamonds are imbedded.

The present invention protects the bit neck from wear during drilling and thus lengthens bit life. The concepts disclosed herein can be used alone or in conjunction with the placement of wear resistant inserts or hardfacing on the nozzle boss. Similarly, the concepts disclosed herein can be combined with the use of bits configured so that their legs have trailing sides that are larger than their leading sides, with bits having nozzle boss guards above their nozzles, and with bits having legs whose center panels extend from the bit's longitudinal axis at least 16% farther than the corresponding radial extension of their nozzle bosses.

What is claimed is:

1. A drill bit for boring a bore hole in an earthen formation, comprising:

a bit body having a pin end, a cutting end and a longitudinal axis and including at least two legs extending from said cutting end, each of said legs including a leading side surface, a trailing side surface, and a shoulder, each of said legs further including a bearing and a cutter cone rotatably supported on said bearing;

said bit body further including a fluid flow system, including a flowway in said pin end, said flowway being in fluid communication with at least one exit port in said cutting end;

said bit body further including a neck between said shoulders and said pin end and a hard, wear-resistant material on at least a portion of said neck; and wherein said hard, wear-resistant material extends radially from said neck to a distance less than full gage of the drill bit.

2. The drill bit according to claim 1 wherein said hard, wear-resistant material on said neck is selected from the group consisting of welded-on hard metal, flame spray applied hard metal, D-gun coating, and sintered tungsten carbide inserts.

3. The drill bit according to claim 1 wherein said hard, wear-resistant material is applied to portions of said neck between said shoulders and said pin end.

4. The drill bit according to claim 1 wherein said exit port is housed in a nozzle having a nozzle boss and said hard, wear-resistant material is applied to portions of said neck between said nozzle boss and said pin end.

5. The drill bit according to claim 4 wherein said nozzle boss includes a plurality of wear resistant inserts thereon.

6. The drill bit according to claim 1 wherein at least one of said legs is asymmetric such that its trailing side surface is larger than its leading side surface.

7. The drill bit according to claim 6 wherein said hard, wear-resistant material comprises an annular piece.

8. The drill bit according to claim 1 wherein said hard, wear-resistant material is applied to the entire circumference of said neck.

9. The drill bit according to claim 1 wherein said shoulders have a plurality of wear resistant inserts thereon.

10. The drill bit according to claim 1 wherein the bit defines a gage curve and wherein said bit body further includes a transition between said neck and said pin end, wherein a substantial portion of said hard, wear-resistant material is closer to said transition that it is to the gage curve.

11. A drill bit for boring a bore hole in an earthen formation, comprising:

a bit body having a pin end, a cutting end and a longitudinal axis and including at least two legs extending from said cutting end, each of said legs including a leading side surface, a trailing side surface, and a shoulder, each of said legs further including a bearing and a cutter cone rotatably supported on said bearing;

said bit body further including a fluid flow system, including a flowway in said pin end, said flowway being in fluid communication with at least one exit port in said cutting end;

said bit body further including a neck between said shoulders and said pin end and a hard, wear-resistant material on at least a portion of said neck;

wherein said exit port is housed in a nozzle having a nozzle boss and said hard, wear-resistant material is applied to portions of said neck between said nozzle boss and said pin end; and wherein said nozzle boss includes a nozzle boss guard.

12. The drill bit according to claim 11, wherein said nozzle boss guard includes a hard, wear-resistant material thereon.

13. The drill bit according to claim 12, wherein said hard, wear-resistant material comprises wear resistant inserts.

14. A drill bit for boring a bore hole in an earthen formation, comprising:

a bit body having a pin end, a cutting end and a longitudinal bit axis and including at least two legs extending from said cutting end, each of said legs including a bearing and rotatably supporting a cutter cone on said bearing, said bit body further including a neck between said legs and said pin end and a fluid flow system;

each of said legs including a leading side surface, a trailing side surface, and a center panel, at least one of said legs being asymmetric such that its trailing side surface is larger than its leading side surface;

said fluid flow system including a flowway in said pin end in fluid communication with at least one exit port in said cutting end, said exit port being defined by a nozzle boss and disposed adjacent to one of said legs; and a hard, wear resistant material on at least a portion of said neck.

15. The drill bit according to claim 14 wherein said shoulders have a plurality of wear resistant inserts thereon.

16. A drill bit for boring a bore hole in an earthen formation, comprising:

a bit body having a pin end, a cutting end and a longitudinal bit axis and including at least two legs extending from said cutting end, each of said legs including a bearing and rotatably supporting a cutter cone on said bearing, said bit body further including a neck between said legs and said pin end and a fluid flow system;

each of said legs including a leading side surface, a trailing side surface, and a center panel, at least one of said legs being asymmetric such that its trailing side surface is larger than its leading side surface;

said fluid flow system including a flowway in said pin end in fluid communication with at least one exit port in said cutting end, said exit port being defined by a nozzle boss and disposed adjacent to one of said legs;

a hard, wear resistant material on at least a portion of said neck; and further including a nozzle boss guard adjacent said nozzle boss.

17. The drill bit according to claim 16, further including a hard, wear-resistant material on said nozzle boss guard.

18. A drill bit for boring a bore hole in an earthen formation, comprising:

a bit body having a pin end, a cutting end and a longitudinal bit axis, at least two legs extending from said cutting end and including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel, each of said legs being asymmetric such that more of the mass of said bit body lies between said trailing side surface and a plane through said bit axis and the center of said center panel than lies between said leading side surface and said plane;

said bit body further including a lubrication system in said one of said legs, said lubrication system comprising a lubricant reservoir in fluid communication with said bearing, said reservoir comprising a cavity formed in said leg and having an opening in said trailing side surface of said one of said legs; and a hard, wear-resistant material on at least a portion of said neck.

19. The drill bit according to claim 18 wherein said hard, wear-resistant material on said neck is selected from the group consisting of welded-on hard metal, flame spray applied hard metal, D-gun coating, and sintered tungsten carbide inserts.

20. The drill bit according to claim 18 wherein said nozzle boss includes a plurality of wear resistant inserts thereon.

21. The drill bit according to claim 18 wherein the radial extension of said center panel from said longitudinal bit axis is at least 16% greater than the corresponding radial extension of said nozzle boss.

22. The drill bit according to claim 21 wherein the hard, wear-resistant material on said neck is a continuous ring.

23. A drill bit for boring a bore hole in an earthen formation, comprising:

a bit body having a pin end, a cutting end and a longitudinal bit axis, at least two legs extending from said cutting end and including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel, each of said legs being asymmetric such that more of the mass of said bit body lies between said trailing side surface and a plane through said bit axis and the center of said center panel than lies between said leading side surface and said plane;

said bit body further including a lubrication system in said one of said legs, said lubrication system comprising a lubricant reservoir in fluid communication with said bearing, said reservoir comprising a cavity formed in said leg and having an opening in said trailing side surface of said one of said legs;

a hard, wear-resistant material on at least a portion of said neck; and further including a nozzle boss guard on said one of said legs above said nozzle boss.

24. The drill bit according to claim 23, further including a hard, wear-resistant material having a hardness greater than that of steel on said nozzle boss guard.

25. The drill bit according to claim 23, further including a plurality of wear resistant inserts on said nozzle boss guard.

26. A drill bit for boring a bore hole in an earthen formation, comprising:

a bit body having a pin end, a cutting end and a longitudinal axis and including at least two legs extending from said cutting end, each of said legs including a leading side surface, a trailing side surface, and a shoulder, each of said legs further including a bearing and a cutter cone rotatably supported on said bearing;

said bit body further including a fluid flow system, including a flowway in said pin end, said flowway being in fluid communication with at least one exit port in said cutting end;

said bit body further including a neck between said shoulders and said pin end and a hard, wear-resistant material on at least a portion of said neck; and said bit body further including a connection between said neck and said pin end, wherein a substantial portion of said hard, wear-resistant material is in close proximity to said connection.

* * * * *